US011147331B1

(12) United States Patent
Rosario

(10) Patent No.: US 11,147,331 B1
(45) Date of Patent: Oct. 19, 2021

(54) GLASSES/CAP SYSTEM

(71) Applicant: Israel Rosario, Davie, FL (US)

(72) Inventor: Israel Rosario, Davie, FL (US)

( * ) Notice: Subject to any disclaimer, the term of this patent is extended or adjusted under 35 U.S.C. 154(b) by 0 days.

(21) Appl. No.: 17/156,531

(22) Filed: Jan. 23, 2021

Related U.S. Application Data

(60) Provisional application No. 62/978,891, filed on Feb. 20, 2020.

(51) Int. Cl.
*A42B 1/247* (2021.01)
*A42B 1/22* (2006.01)

(52) U.S. Cl.
CPC ..... *A42B 1/247* (2013.01); *A42B 1/22* (2013.01)

(58) Field of Classification Search
CPC ..... A42B 1/247; A42B 1/22; A42B 1/225; A42B 3/185; G02C 3/02; G02C 3/006; G02C 2200/02
See application file for complete search history.

(56) References Cited

U.S. PATENT DOCUMENTS 4,179,753 A * 12/1979 Aronberg ..... A42B 1/247 2/10
4,640,287 A * 2/1987 Anderson ..... A44B 18/00 450/36
5,737,054 A * 4/1998 Chao ..... G02C 9/00 351/47
6,174,058 B1 * 1/2001 Hsiao ..... G02C 3/02 351/155
6,283,594 B1 * 9/2001 Hamano ..... G02C 3/00 351/130
6,764,175 B1 * 7/2004 Chen ..... G02C 9/00 351/47
7,496,991 B2 * 3/2009 Avery ..... G02C 3/04 24/3.3
8,696,112 B1 * 4/2014 Vaught ..... G02C 3/02 351/155
2006/0050224 A1 * 3/2006 Smith ..... G02C 9/00 351/47
2006/0152671 A1 * 7/2006 Risso ..... G02C 3/02 351/155
2006/0203188 A1 * 9/2006 Zelman ..... G02C 9/00 351/141
2008/0282517 A1 * 11/2008 Claro ..... A42B 1/22 24/303
2009/0103043 A1 * 4/2009 Ramsey ..... G02C 3/02 351/155
2009/0284712 A1 * 11/2009 Brooks ..... G02C 3/02 351/155
2010/0212066 A1 * 8/2010 Gilman ..... G02C 3/02 2/209.13
2012/0216374 A1 * 8/2012 Manuello ..... A41F 1/002 24/303
2013/0278883 A1 * 10/2013 Lenz ..... G02C 3/003 351/123

(Continued)

*Primary Examiner* — Heather Mangine
(74) *Attorney, Agent, or Firm* — Sandra L. Layer

(57) ABSTRACT

A glasses/cap system for separably coupling glasses to a cap and for securing the glasses to the hat in either a usage orientation or a storage orientation. The coupling components mainly consisting of complementary magnets and ferromagnetic materials located in reciprocal parts of the glasses and cap alone or in combination with push type or bungee type connectors.

5 Claims, 4 Drawing Sheets

(56) References Cited

U.S. PATENT DOCUMENTS

| | | | | |
|---|---|---|---|---|
| 2014/0013480 | A1* | 1/2014 | Treger | G02C 3/02 2/10 |
| 2014/0063443 | A1* | 3/2014 | Berger | A42B 1/247 351/155 |
| 2015/0013114 | A1* | 1/2015 | Grame | A45F 5/02 24/3.8 |
| 2015/0098055 | A1* | 4/2015 | Tahsler | G02C 3/02 351/155 |
| 2015/0131049 | A1* | 5/2015 | Lando | G02C 3/006 351/123 |
| 2015/0346509 | A1* | 12/2015 | Walker | G02C 3/02 351/155 |
| 2018/0055128 | A1* | 3/2018 | Hall, Sr. | A42B 1/247 |
| 2018/0092427 | A1* | 4/2018 | Jacobsen | A42B 3/063 |
| 2018/0129067 | A1* | 5/2018 | Boedecker | G02C 11/00 |
| 2018/0177257 | A1* | 6/2018 | Sears | A45F 5/02 |
| 2018/0335640 | A1* | 11/2018 | Fulks | G02C 5/14 |
| 2019/0101772 | A1* | 4/2019 | Lowe | A42B 1/247 |
| 2019/0116904 | A1* | 4/2019 | Popoca Perez | A41F 1/002 |
| 2019/0183201 | A1* | 6/2019 | Defino | A42B 1/22 |
| 2019/0246731 | A1* | 8/2019 | Luo | G02C 3/02 |
| 2019/0376646 | A1* | 12/2019 | Pombo | F16M 13/04 |
| 2020/0159039 | A1* | 5/2020 | Masters | A42B 1/24 |
| 2020/0205499 | A1* | 7/2020 | Draper | G02C 3/003 |
| 2020/0253296 | A1* | 8/2020 | Washio | A42B 1/048 |
| 2021/0000208 | A1* | 1/2021 | Whedbee, II | A42B 1/247 |

* cited by examiner

FIG. 1
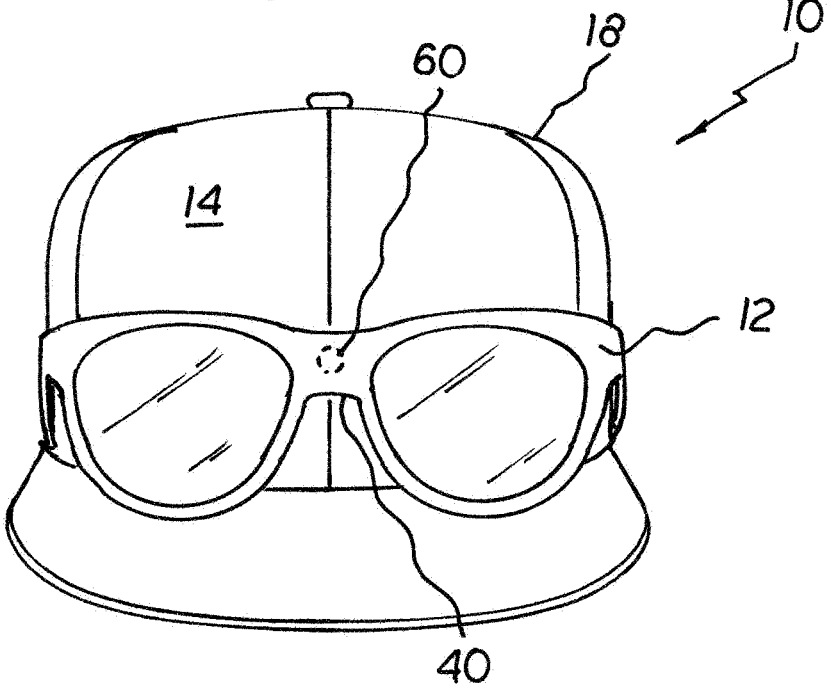
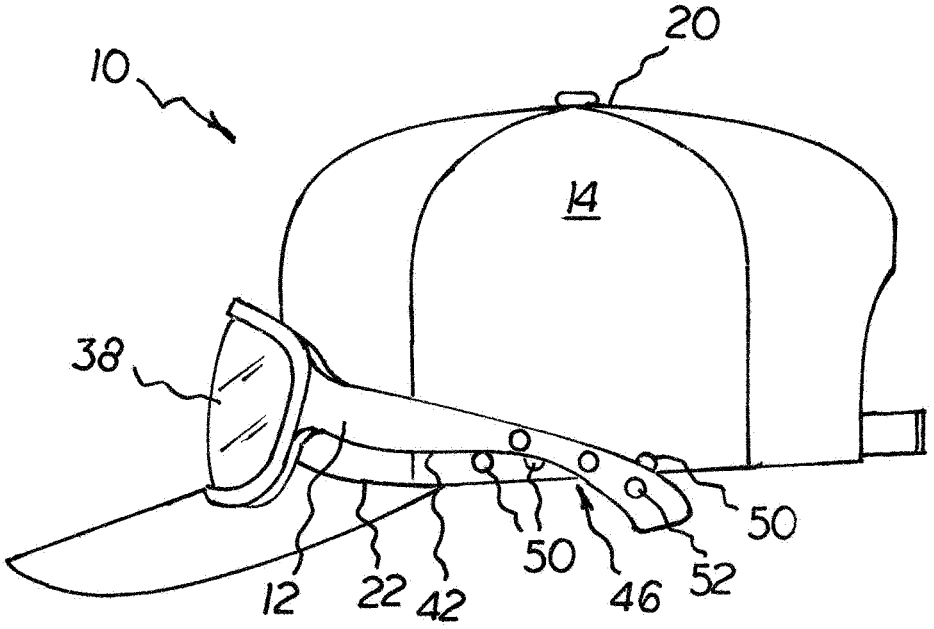
FIG 2

GLASSES/CAP SYSTEM

RELATED APPLICATION

The present patent application claims priority to the corresponding provisional patent application Ser. No. 62/978,891, entitled "GLASSES/CAP SYSTEM" filed on Feb. 20, 2020, the subject matter of which incorporated herein by reference.

BACKGROUND OF THE INVENTION

Field of the Invention

The present invention relates to a glasses/cap system and more particularly pertains to separably coupling glasses to a cap and for securing the glasses in either a usage orientation or a storage orientation. The coupling and the securing being done in a safe, convenient, and economical manner.

Description of the Prior Art

The use of glasses and caps of known design and configurations is known in the prior art. More specifically, glasses and caps of known designs and configurations previously devised and utilized for the purpose of securing glasses and caps are known to consist basically of familiar, expected, and obvious structural configurations, notwithstanding the myriad of designs encompassed by the crowded prior art which has been developed for the fulfillment of countless objectives and requirements.

While these known devices fulfill their respective, particular objectives and requirements, they do not describe a glasses/cap system that allows for separably coupling glasses to a cap and for securing the glasses in either a usage orientation or a storage orientation. The coupling and the securing being done in a safe, convenient, and economical manner.

In this respect, the glasses/cap system according to the present invention substantially departs from the conventional concepts and designs of the prior art, and in doing so provides an apparatus primarily developed for the purpose of separably coupling glasses to a cap and for securing the glasses in either a usage orientation or a storage orientation. The coupling and the securing being done in a safe, convenient, and economical manner.

Therefore, it can be appreciated that there exists a continuing need for a new and improved glasses/cap system which can be used for separably coupling glasses to a cap and for securing the glasses in either a usage orientation or a storage orientation. In this regard, the present invention substantially fulfills these needs.

SUMMARY OF THE INVENTION

In view of the foregoing disadvantages inherent in the known types of glasses and caps of known designs and configurations now present in the prior art, the present invention provides an improved glasses/cap system. As such, the general purpose of the present invention, which will be described subsequently in greater detail, is to provide a new and improved glasses/cap system and method which has all the advantages of the prior art and none of the disadvantages.

To attain this, for a broad perspective, the present invention essentially comprises a cap with a closed top, an open bottom and a forwardly extending brim, glasses having a forwardly facing bridge and rearwardly projecting temples and coupling components to separably couple and uncouple the glasses to the cap.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved glasses/cap system which has all of the advantages of the prior art glasses and caps of known designs and configurations and none of the disadvantages.

It is another object of the present invention to provide a new and improved glasses/cap system which may be easily and efficiently manufactured and marketed.

It is a further object of the present invention to provide a new and improved glasses/cap system which is of durable and reliable constructions.

An even further object of the present invention is to provide a new and improved glasses/cap system which is susceptible of a low cost of manufacture with regard to both materials and labor, and which accordingly is then susceptible of low prices of sale to the consuming public, thereby making such glasses/cap system economically available to the buying public.

Lastly, it is an object of the present invention to provide a glasses/cap system for separably coupling glasses to a cap and for securing the glasses in either a usage orientation or a storage orientation.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a glasses/cap system constructed in accordance with the principles of the present invention.

FIG. 2 is a side elevational view taken at line 2-2 of FIG. 1.

FIG. 3*a* shows a plurality of magnets. FIG. 3*b* shows an elongated magnetic strip. FIG. 3*c* shows a slidable magnet. FIG. 3*d* shows a ferrous metal section with a plurality of embedded magnets.

The same reference numerals refer to the same parts throughout the various Figures.

DESCRIPTION OF THE PREFERRED EMBODIMENT

Figure 3A:
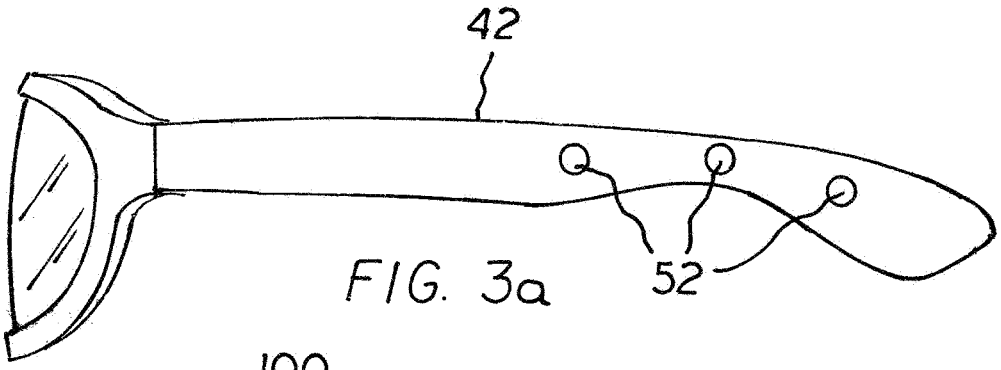
FIGS. 3*a*-3*d* are enlarged showings of various magnets secured to the temples of glasses adapted to be removeably coupled to sides of a cap.

With reference now to the drawings, and in particular to FIG. 1 thereof, the preferred embodiment of the new and improved glasses/cap system embodying the principles and concepts of the present invention and generally designated by the reference numeral 10 will be described.

The present invention, the glasses/cap system 10 is comprised of a plurality of components. Such components are individually configured and correlated with respect to each other so as to attain the desired objective. Such components in their broadest context include a cap, glasses and a support system. The cap 14 has an upper section with a closed top and an open bottom. The open bottom has a brim extending forwardly. The open bottom has an opening located rearwardly. The cap has side sections between the brim and the opening. Next provided is glasses. The glasses include two laterally spaced lenses forwardly and a bridge between the lenses coupling together the lenses interiorly. The glasses include two temples with lengths extending rearwardly from the lenses exteriorly. A support assembly separately couples the glasses with respect to the cap in an operative orientation with the lenses below the brim. The support assembly selectively secures the glasses to the cap in an inoperative orientation with the lenses above the brim.

From a specific perspective, in reference to FIGS. 1 and 2 the preferred embodiment of the invention of the present application is a glasses/cap system 10 for separably coupling glasses 12 to a cap 14 and for securing the glasses in either a usage orientation or a storage orientation. The coupling and the securing being done in a safe, convenient, and economical manner. In the preferred embodiment first provided is a cap 14. The cap has an upper section 18 with a closed top 20 and an open bottom 22. The open bottom has an opening 24 located rearwardly. The opening has size adjustment capabilities through a first strap 30 with rear magnets 28 and a second strap 30 with rear ferromagnetic components 32. The cap has side sections 34 between the brim and the opening.

Next provided in the preferred embodiment are glasses 12. The glasses include two laterally spaced lenses 38 forwardly. The glasses include abridge 40 between the lenses and coupling together the lenses interiorly. The glasses include two temples 42 extending rearwardly from the lenses exteriorly.

Lastly, in the preferred embodiment, a support assembly 46 is provided. The support assembly separably couples the glasses with respect to the cap. The support assembly selectively secures the glasses to the cap in an operative orientation with the lenses below the brim. The support assembly secures the glasses to the cap in an inoperative orientation with the sense above the brim. The support assembly includes a plurality of side magnets 52 laterally spaced along the temples and a plurality of laterally spaced side ferromagnetic components 50 laterally spaced in the lower portion of the side sections 34 along the open bottom.

Figure 4:
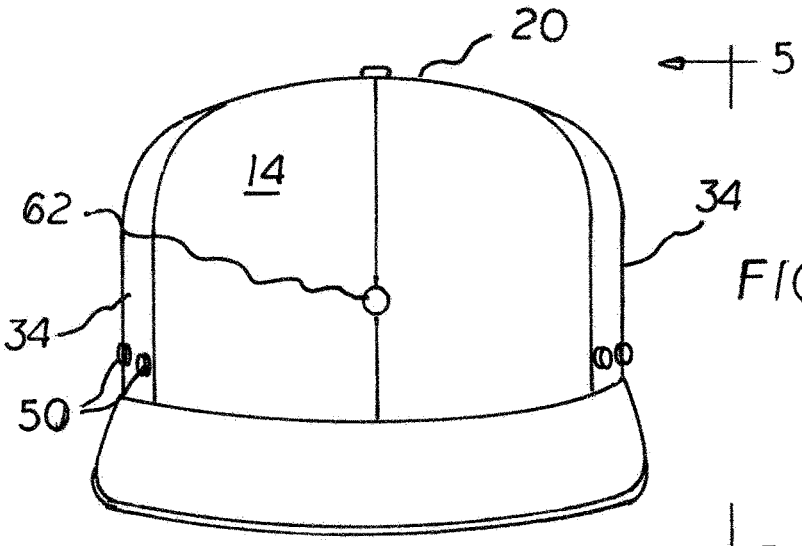
FIG. 4 is a front elevational view of the cap of FIGS. 1 and 2.
Figure 5:
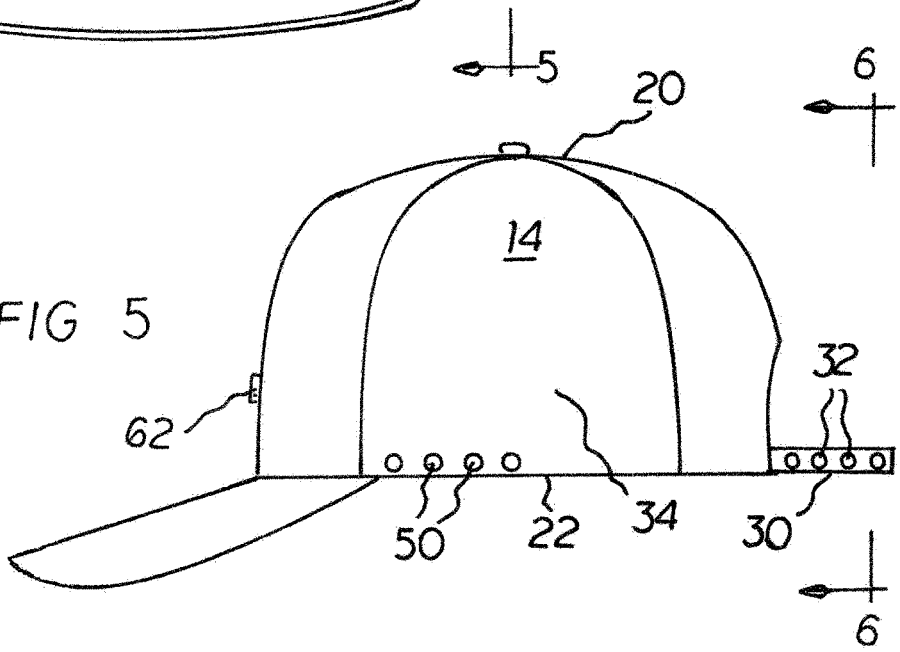
FIG. 5 is a side elevational view taken along lines 5-5 of FIG. 4.
Figure 6:
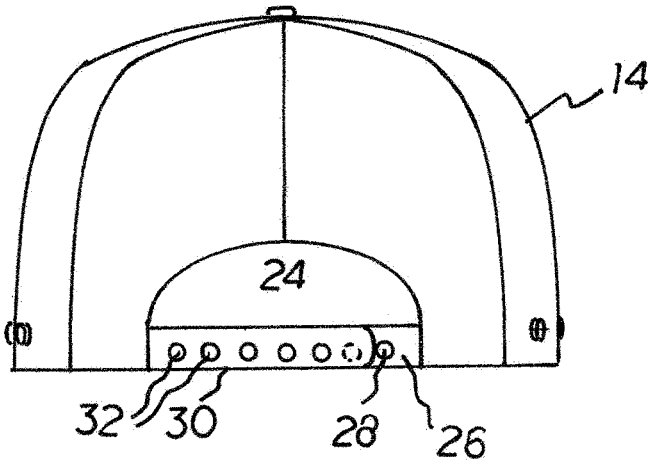
FIG. 6 is a rear elevational view taken along line 6-6 of FIG. 5.
Figure 7:
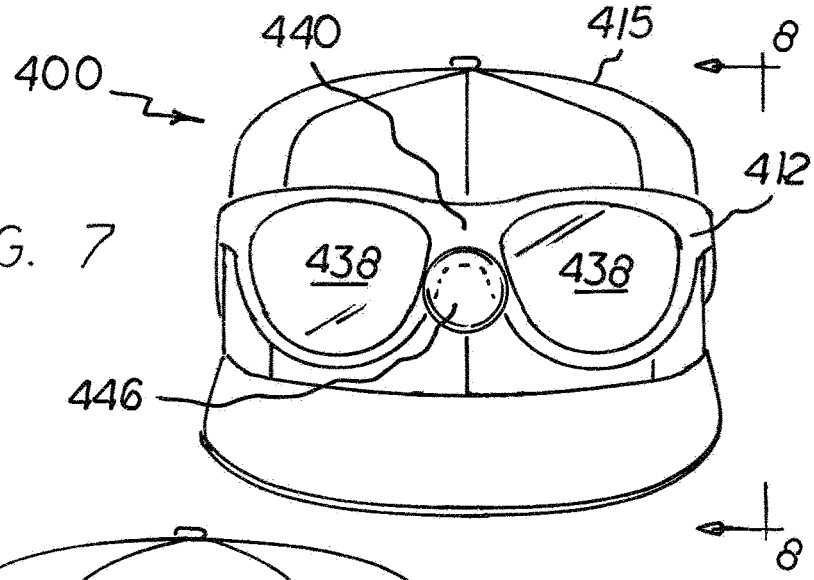
FIG. 7 is a front elevational view of a glasses/cap system constructed in accordance with a alternate embodiment of the invention.
Figure 8:
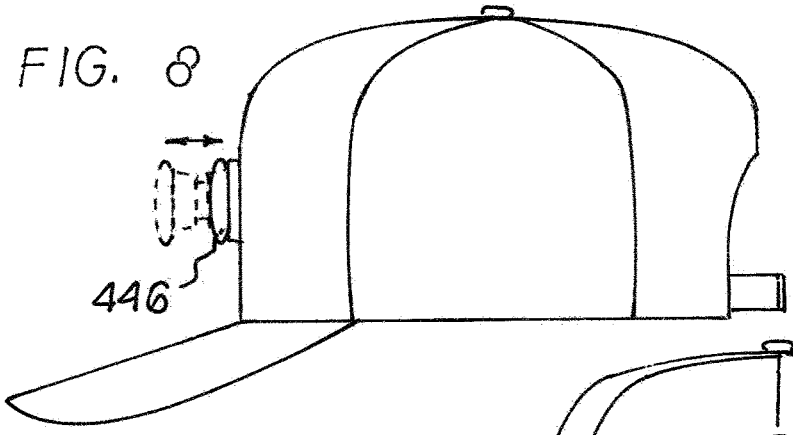
FIG. 8 is a side elevational view taken along line 8-8 of FIG. 7.
Figure 9:
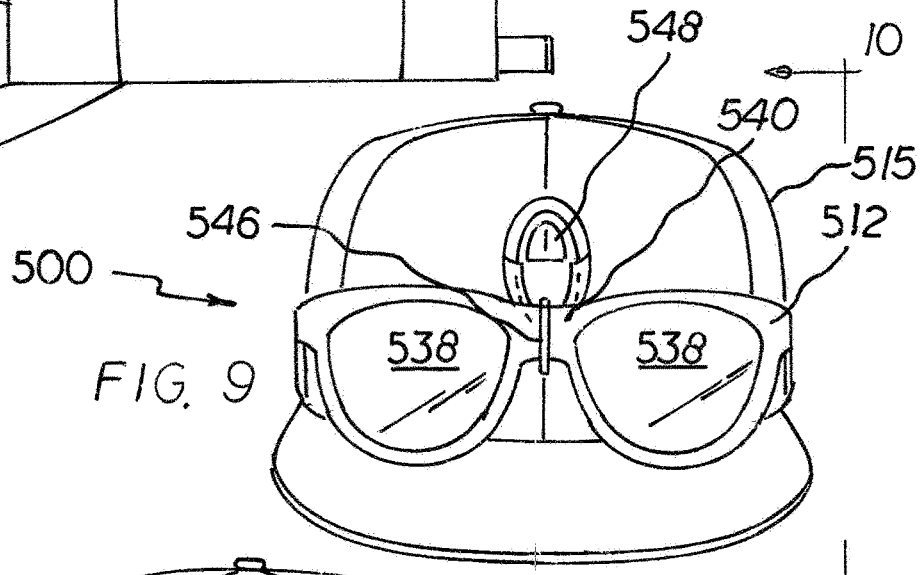
FIG. 9 is a front elevational view of a glasses/cap system constructed in accordance with another alternate embodiment of the invention.
Figure 10:
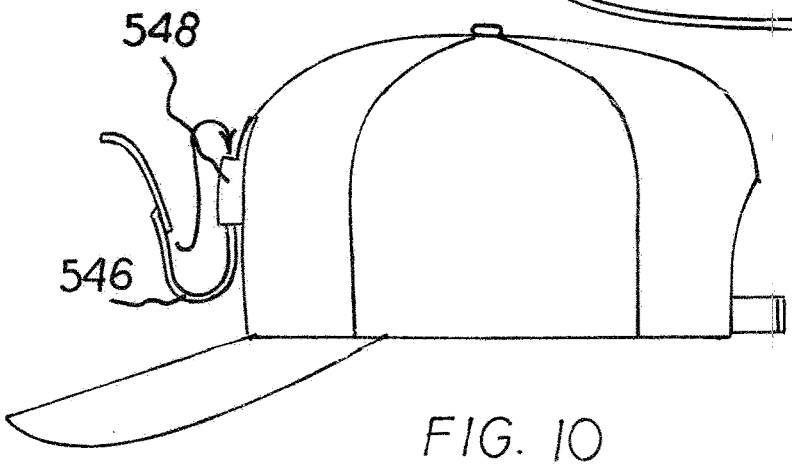
FIG. 10 is a side elevational view taken along line 10-10 of FIG. 9.

In the preferred embodiment the support assembly incudes an additional magnet 60 embedded in the bridge 40 and a ferromagnetic component 62 shown in FIGS. 4 and 5.

Figure 3B:
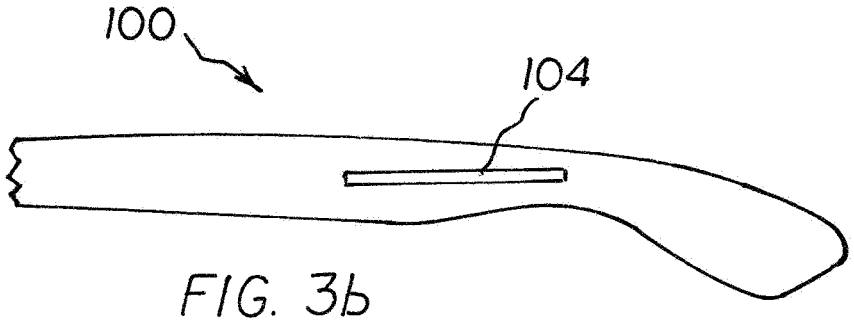

In an alternate embodiment of the glasses/cap system 100, shown in FIG. 3*b*, the support assembly includes two elongated magnets 104, one of the elongated magnets in each temple. Also included are a plurality of laterally spaced side ferromagnetic components 50 laterally spaced in the lower portion of the side sections 34 along the open bottom.

Figure 3C:
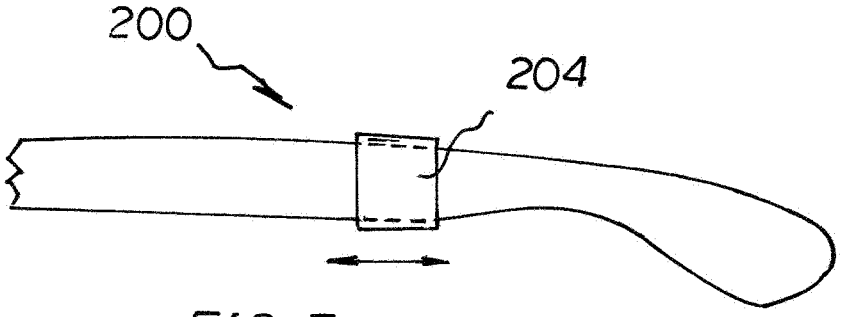

In another alternate embodiment of the glasses/cap system 200, shown in FIG. 3*c*, the support assembly includes two slidable magnets 204, one of the slidable magnets in each temple. In the embodiment, the support assembly also includes a plurality of side ferromagnetic components 50 laterally spaced in the lower portion of the side sections 34 along the open bottom.

Figure 3D:
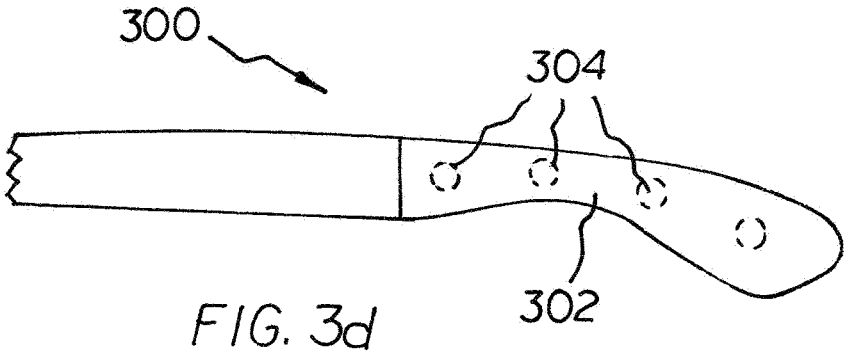

In still another alternate embodiment of the glasses/cap system 300, shown in FIG. 3*d*, the support assembly includes two ferrous metal sections 302 in the temples with pluralities of imbedded magnets, one plurality of imbedded magnets 304 in each ferrous section. This embodiment includes a plurality of laterally spaced side ferromagnetic components 50 laterally spaced in the lower portion of the side sections 34 along the open bottom.

Additional alternate embodiments of the glasses/cap system 400, 500 for coupling glasses 412, 512 to a cap 415, 515 are shown in FIGS. 7 through 10. In these embodiment, the cap has an upper section with a closed top and an open bottom. The open bottom has a brim extending forwardly. The open bottom has an opening located rearwardly. The opening has size adjustment capabilities. The cap has side sections between the brim and the opening. In these embodiments, the glasses include two laterally spaced lenses 438, 538 forwardly. The glasses include a bridge 440, 540 between the lenses coupling together the lenses interiorly. The glasses include two temples extending rearwardly from the lenses exteriorly. Lastly, a support assemble is provided. The support assembly includes a bridge receiving component 446, 546 above the brim. The support assembly separably couples the glasses with respect to the cap. The support assembly selectively secures the glasses to the cap in an operative orientation with the lenses below the brim. The support assembly selectively secures the glasses to the cap in an inoperative orientation with the lenses above the brim.

Support assembly selectively secures the glasses to the cap in an operative orientation with the lenses below the brim. The support assembly selectively secures the glasses to the cap in an inoperative orientation with the lenses above the brim.

In an alternate embodiment of the glasses/cap system 400, the bridge receiving component 446 includes a mushroom shaped element adapted to be retracted when the lenses are in the use below the brim and to be extended for supporting the bridge when the lenses are not in use above the brim.

In a final embodiment of the glasses/cap system 500, the bridge receiving component 546 includes a bungee cord type connector having an elastic cord with an upper retaining closure 548 adapted to be opened when moving the lenses from the in-use position below the brim and to be closed for retaining the bridge when the lenses are not in use above the brim.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A glasses/cap system for separably coupling glasses to a cap in a safe, convenient and economical manner, the system comprising, in combination:

the cap with a closed top and an open bottom, the open bottom having a lower edge, a forward facing section, two side sections and a rearward facing section, a forwardly extending brim extending from the lower edge of the forward facing section;

the glasses comprising a forwardly facing bridge and rearwardly projecting temples;

coupling components to separably couple and uncouple the glasses to the cap, the coupling components comprised of magnets on the rearwardly projecting temples of the glasses and ferromagnetic components laterally spaced in the two side sections adjacent to and above the lower edge along the open bottom of the cap;

a magnet imbedded centrally in the forwardly facing bridge, a ferromagnetic component attached to the forward facing section above the forwardly extending brim of the cap; and an opening in the rearward facing section of the cap, a first strip and a second strip, the first strip extending laterally from a first side of the opening, and the second strip extending laterally from a second side of the opening, the first strip comprising laterally spaced magnets and the second strip comprising ferromagnetic components, the the first strip and the second strip overlapping at various distances aligning the magnets and ferromagnetic components to accommodate various head sizes.

2. The system set forth in claim 1 wherein the coupling components comprised of magnets on the rearwardly projecting temples of the glasses include a plurality of laterally spaced magnets on the rearwardly projecting temples of the glasses.

3. The system set forth in claim 1 wherein the coupling components comprised of magnets on the rearwardly projecting temples of the glasses include an elongated rectangular magnet in each of the rearwardly projecting temples of the glasses.

4. The system set forth in claim 1 wherein the coupling components comprised of magnets on the rearwardly projecting temples of the glasses include a slidable magnet coupled to each of the rearwardly projecting temples of the glasses.

5. The system set forth in claim 1 wherein the coupling components comprised of magnets on the rearwardly projecting temples of the glasses includes two ferrous metal sections with pluralities of imbedded magnets in the rearwardly projecting temples of the glasses.

* * * * *